US007907858B2

(12) United States Patent
Monahan et al.

(10) Patent No.: US 7,907,858 B2
(45) Date of Patent: Mar. 15, 2011

(54) METHOD AND APPARATUS FOR AUTOMATICALLY ADJUSTING NIP WIDTH BASED ON A SCANNED NIP PRINT IN AN IMAGE PRODUCTION DEVICE

(75) Inventors: Melissa Ann Monahan, Rochester, NY (US); William A. Burton, Fairport, NY (US); Paul Michael Fromm, Rochester, NY (US); Eric Scott Hamby, Fairport, NY (US); Lawrence Arnold Clark, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 186 days.

(21) Appl. No.: 12/363,817

(22) Filed: Feb. 2, 2009

(65) Prior Publication Data

US 2010/0196034 A1 Aug. 5, 2010

(51) Int. Cl.
*G03G 15/20* (2006.01)

(52) U.S. Cl. ..... 399/67

(58) Field of Classification Search ..... 399/67, 399/68, 69, 320, 322, 328, 330, 339; 219/216, 219/469, 470, 471
See application file for complete search history.

(56) References Cited

U.S. PATENT DOCUMENTS

| | | | | |
|---|---|---|---|---|
| 4,972,232 | A * | 11/1990 | Hoover et al. | 399/122 |
| 5,562,027 | A * | 10/1996 | Moore | 100/35 |
| 5,953,230 | A * | 9/1999 | Moore | 700/122 |
| 6,201,938 | B1 * | 3/2001 | Hollar et al. | 399/67 |
| 6,205,369 | B1 * | 3/2001 | Moore | 700/122 |
| 6,430,459 | B1 * | 8/2002 | Moore | 700/122 |
| 6,819,890 | B1 * | 11/2004 | Bott et al. | 399/67 |
| 2005/0135851 | A1 * | 6/2005 | Ng et al. | 399/341 |
| 2005/0220473 | A1 * | 10/2005 | Bott et al. | 399/67 |
| 2006/0020418 | A1 * | 1/2006 | Moore et al. | 702/170 |
| 2008/0245979 | A1 | 10/2008 | Banton et al. | |
| 2010/0086333 | A1 * | 4/2010 | Kim | 399/328 |
| 2010/0150585 | A1 * | 6/2010 | Monahan et al. | 399/33 |
| 2010/0150587 | A1 * | 6/2010 | Hanfland et al. | 399/45 |
| 2010/0183346 | A1 * | 7/2010 | Kagawa et al. | 399/327 |
| 2010/0215381 | A1 * | 8/2010 | Li et al. | 399/9 |
| 2010/0303493 | A1 * | 12/2010 | Hamby et al. | 399/67 |

OTHER PUBLICATIONS

Martin E. Banton et al,: U.S. Appl. No. 12/023,306, filed Jan. 31, 2008.

* cited by examiner

*Primary Examiner* — David P Porta
*Assistant Examiner* — David S Baker
(74) *Attorney, Agent, or Firm* — Ronald E. Prass, Jr.; Prass LLP

(57) ABSTRACT

A method and apparatus for automatically adjusting nip width based on a scanned nip print in an image production device is disclosed. The method may include automatically inserting a sheet of media into a fuser nip in the image production device upon receiving a signal from a user interface, the fuser nip being an intersection of the fuser roll and the pressure roll, generating a nip print in the fuser nip, the nip print being an image created from the pressure between the fuser roll and the pressure roll, scanning the nip print, determining if a nip width adjustment is required based on the scanned nip print, the nip width being the distance of an arc length created by an intersection of the fuser roll and the pressure roll, and if it is determined that a nip width adjustment is required based on the scanned nip print, adjusting the nip width.

21 Claims, 5 Drawing Sheets

METHOD AND APPARATUS FOR AUTOMATICALLY ADJUSTING NIP WIDTH BASED ON A SCANNED NIP PRINT IN AN IMAGE PRODUCTION DEVICE

BACKGROUND

Disclosed herein is a method for automatically adjusting nip width based on a scanned nip print in an image production device, as well as corresponding apparatus and computer-readable medium.

The nip width is the measured arc distance created by the intersection of a soft fuser roll and a hard pressure roll in an image production device, such as a printer, copier, multi-function device, etc, which enables heat transfer and pressure needed to fuse prints. If the nip width is not set properly, toner is improperly melted and pressed (fused) against the paper resulting in image quality defects. In addition, improper nip setting can result in excessive wear of the fuser roll surface which results in image quality defects in the form of areas containing unacceptable differential gloss.

An accurate and consistent nip width increases fuser roll life by helping to minimize edge wear on the roll. It has been shown that uneven and excessive nip settings, inboard to outboard, result in accelerated edge wear. The nip width is supposed to be checked and adjusted with every fuser roll replacement. This measurement is not always done and combined with roll hardness varying significantly between batches, the roll nip widths are frequently set incorrectly. In addition, as the fuser roll ages the softness of the rubber changes resulting in less-than-optimum nip widths.

Conventional nip set up procedure requires the operator to manually load a blank piece of paper into the fuser nip to make an impression, dust the impressions with toner, and then measure the nip width with a small scale. Although this procedure is in the service documentation, it is not often performed with each fuser roll change. This manual process also leads to nip width variability. Although the variability may be within specification, it still results in significant delta gloss variability due to edge wear.

SUMMARY

A method and apparatus for automatically adjusting nip width based on a scanned nip print in an image production device is disclosed. The method may include automatically inserting a sheet of media into a fuser nip in the image production device upon receiving a signal from a user interface, the fuser nip being an intersection of the fuser roll and the pressure roll, generating a nip print in the fuser nip, the nip print being an image created from the pressure between the fuser roll and the pressure roll, scanning the nip print, determining if a nip width adjustment is required based on the scanned nip print, the nip width being the distance of an arc length created by an intersection of the fuser roll and the pressure roll, and if it is determined that a nip width adjustment is required based on the scanned nip print, adjusting the nip width.

DETAILED DESCRIPTION

Figure 1:
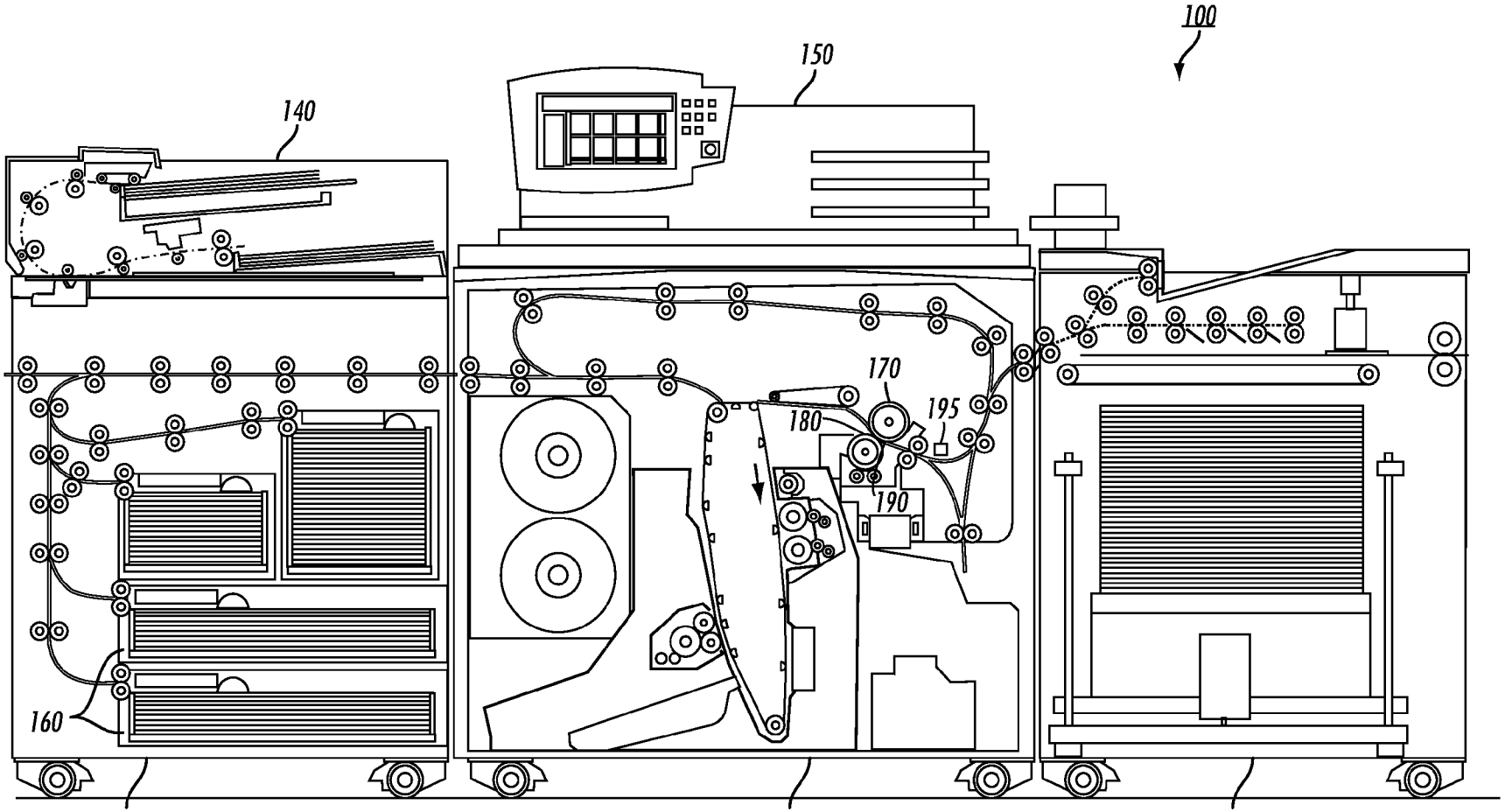
FIG. 1 is a diagram of an exemplary image production device in accordance with one possible embodiment of the disclosure.

Aspects of the embodiments disclosed herein relate to a method for automatically adjusting nip width based on a scanned nip print in an image production device, as well as corresponding apparatus and computer-readable medium.

The disclosed embodiments may include a method for automatically adjusting nip width based on a scanned nip print in an image production device. The method may include automatically inserting a sheet of media into a fuser nip in the image production device upon receiving a signal from a user interface, the fuser nip being an intersection of the fuser roll and the pressure roll, generating a nip print in the fuser nip, the nip print being an image created from the pressure between the fuser roll and the pressure roll, scanning the nip print, determining if a nip width adjustment is required based on the scanned nip print, the nip width being the distance of an arc length created by an intersection of the fuser roll and the pressure roll, and if it is determined that a nip width adjustment is required based on the scanned nip print, adjusting the nip width.

The disclosed embodiments may further include an image production device that may include a user interface that receives inputs from an operator, a feeder section that feeds a media sheet to produce images in the image production device, a scanner that scans a nip print, the nip print being an image created from the pressure between the fuser roll and the pressure roll, and a nip print adjustment unit that sends a signal to the feeder section to automatically insert a sheet of media into a fuser nip in the image production device upon receiving a signal from the user interface, the fuser nip being an intersection of the fuser roll and the pressure roll, generates a nip print in the fuser nip, sends a signal to the scanner to scan the nip print, determines if a nip width adjustment is required based on the scanned nip print, the nip width being the distance of an arc length created by an intersection of the fuser roll and the pressure roll, and if the nip print adjustment unit determines that a nip width adjustment is required based on the scanned nip print, the nip print adjustment unit adjusts the nip width.

The disclosed embodiments may further include a computer-readable medium storing instructions for controlling a computing device for automatically adjusting nip width based on a scanned nip print in an image production device. The instructions may include automatically inserting a sheet of media into a fuser nip in the image production device upon receiving a signal from a user interface, the fuser nip being an intersection of the fuser roll and the pressure roll, generating a nip print in the fuser nip, the nip print being an image created from the pressure between the fuser roll and the pressure roll, scanning the nip print, determining if a nip width adjustment is required based on the scanned nip print, the nip width being the distance of an arc length created by an intersection of the fuser roll and the pressure roll, and if it is determined that a nip width adjustment is required based on the scanned nip print, adjusting the nip width.

The disclosed embodiments may concern a method and apparatus for automatically adjusting nip width based on a scanned nip print in an image production device. In particular, the disclosed embodiments may concern measuring the delta gloss of an automated nip print using a built in/in-line scanner or an external scanner. The scanner could be either a delta gloss meter for example, that uses a fixed angle to scan the print or a more advanced type that uses multiple angles. The delta gloss measurement value may be fed back to an automatic nip adjustment unit. The procedure may be required after each fuser roll change and at periodic intervals between jobs.

The proposed setup may use the existing simplex or duplex loop and a built in scanner to measure the fuser nip. For example, the nip print may be a full page half tone image that is fused during the simplex pass and then stopped in the fuser during the duplex pass. The nip print may be scanned with an inline print scanner, resulting in a delta gloss measurement that is correlated to the nip adjustment unit. An automatic nip width adjustment device may move the fuser and pressure roll center to center distance either by lead screw or cam adjustment, for example. An alternative technique may be to use a pressure sensitive film instead of a toned print to provide a color map of the nip arc. The scanner could be inline or external, requiring human intervention to handle the print. Independent inboard and outboard edge measurements may be taken to ensure uniformity. A ladder chart printed on the substrate may be used to measure paper speed.

This process may reduce fuser roll edge wear rate by reducing the mean and variability of the nip width. The process also provides an advantage over the manual procedure because of its accuracy and automated operation, which may occur during continuous motion, for example.

If integrated into the fuser roll change procedure, a prompt requiring the nip print scanning process may appear on the Print Station Interface Platform (PSIP) Graphical Use Interface (GUI). Thus, the operator may be more likely to complete the nip setup routine after each roll change or at designated intervals.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module may include any number of trays 160, each of which may store a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media are advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more images thereon.

In this embodiment, the image production section 120 is shown to be a monochrome xerographic type engine, although other types of engines, such as color xerographic, ionographic, or ink-jet may be used. In FIG. 1, the image production section 120 may include a photoreceptor which may be in the form of a rotatable belt. The photoreceptor may be called a "rotatable image receptor," meaning any rotatable structure such as a drum or belt which can temporarily retain one or more images for printing. Such an image receptor can comprise, by way of example and not limitation, a photoreceptor, or an intermediate member for retaining one or more marking material layers for subsequent transfer to a sheet, such as in a color xerographic, offset, or ink-jet printing apparatus.

The photoreceptor may be entrained on a number of rollers, and a number of stations familiar in the art of xerography are placed suitably around the photoreceptor, such as a charging station, imaging station, development station, and transfer station. In this embodiment, the imaging station is in the form of a laser-based raster output scanner, of a design familiar in the art of "laser printing," in which a narrow laser beam scans successive scan lines oriented perpendicular to the process direction of the rotating photoreceptor. The laser may be turned on and off to selectably discharge small areas on the moving photoreceptor according to image data to yield an electrostatic latent image, which is developed with marking material at development station and transferred to a sheet at transfer station.

A sheet having received an image in this way is subsequently moved through fuser section that may include a fuser roll 170 and a pressure roll 180, of a general design known in the art, and the heat and pressure from the fuser roll 170 causes the marking material image to become substantially permanent on the sheet. The fuser nip 190 is shown as the arc distance between the fuser roll 170 and the pressure roll 180. The sheet once printed, may then be moved to output section 130, where it may be collated, stapled, folded, etc., with other media sheets in a manner familiar in the art.

Although the above description is directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

The nip print scanner 195 may be any scanner that has the ability to scan nip prints in the image production device 100 and provide the resulting nip width information from the scanned nip print as feedback to determine if nip width adjustments need to be made. While the nip print scanner 195 is shown as an in-line scanner, one of skill in the art will appreciate that other scanners may be used, such as external scanners. For example, the document scanning device on the image production device 100 may be used to scan the nip print.

Figure 2:
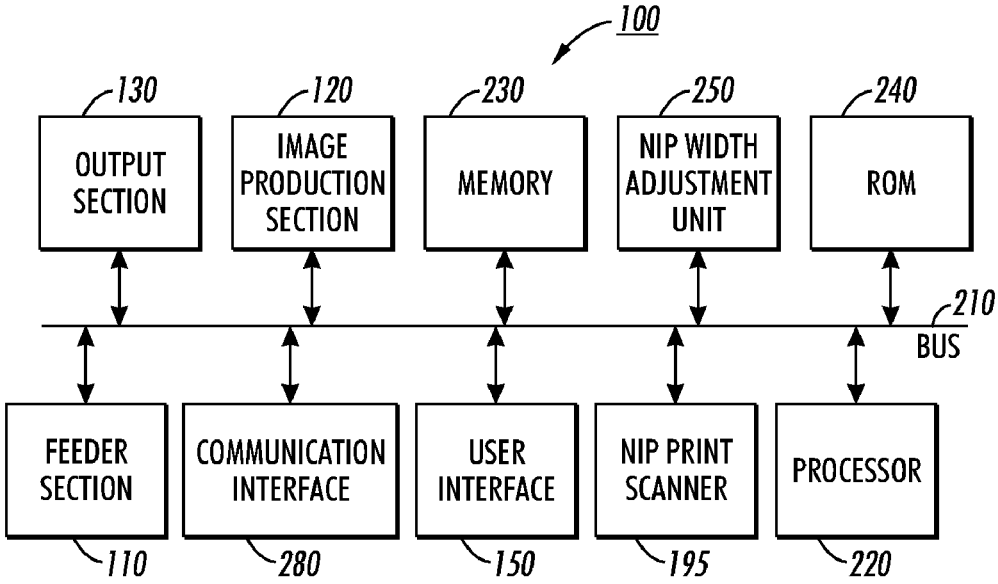
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory ROM) 240, a nip width adjustment unit 250, a feeder section 110, an output section 130, a user interface 150, a communication interface 280, an image production section 120, and a nip print scanner 195. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Feeder section 110 may be any mechanism that may feed media sheets to the image production section 120 to produce imaged media. The image production section 120 may include an image printing and/or copying section, a scanner, a fuser, etc., for example. Output section 130 may include one or more conventional mechanisms that output image production documents to the user, including output trays, output paths, finishing section, etc., for example. As stated above, the nip print scanner 195 may be any scanner that has the ability to scan nip prints and provide them to the nip width adjustment unit 250 for a determination as to whether a nip width adjustment is necessary. For example, a scanner that may pick up specular signals could detect gloss differentials and may be used as the nip print scanner 195.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
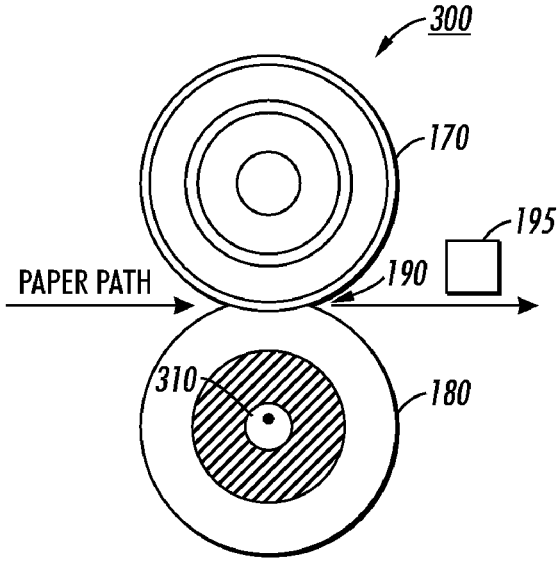
FIG. 3 is an exemplary diagram of the nip print scanning environment in accordance with one possible embodiment of the disclosure.

FIG. 3 is an exemplary diagram of the nip print scanning environment 300 in accordance with one possible embodiment of the disclosure. The nip print scanning environment 300 may be found in the image production section 120 and may include the fuser roll 170, the pressure roll 180, the fuser nip 190, the scanner 195, and a nip width adjustment device 310.

When dictated by the operator pressing a soft or hard button at the user interface 150, a media sheet may be fed automatically by the feeder section 110 into the fuser nip 190. If integrated into the fuser roll change procedure, a prompt requiring the nip print scanning process may appear on the Print Station Interface Platform (PSIP) Graphical User Interface (GUI). However, the nip width adjustment unit 250 may automatically schedule nip prints to be generated at a fuser roll change or automatically, for example. The media sheet may be paused in the fuser nip 190 for 10-30 seconds to make a nip print (or as long as necessary to get a proper gloss differential).

When implemented using the duplex mode, a nip print may be generated using a media sheet with a scale (ruler or ladder chart) or halftone image on side 1 of the sheet. On the second pass through the paper path, the sheet may be stopped in the fuser nip 190 for 10-30 seconds (or as long as necessary to get a proper gloss differential). The rolls are cammed-in/loaded, creating a band of higher gloss. The nip print may then be jettisoned through the fuser and passed through the nip print scanner 195.

Figure 4:
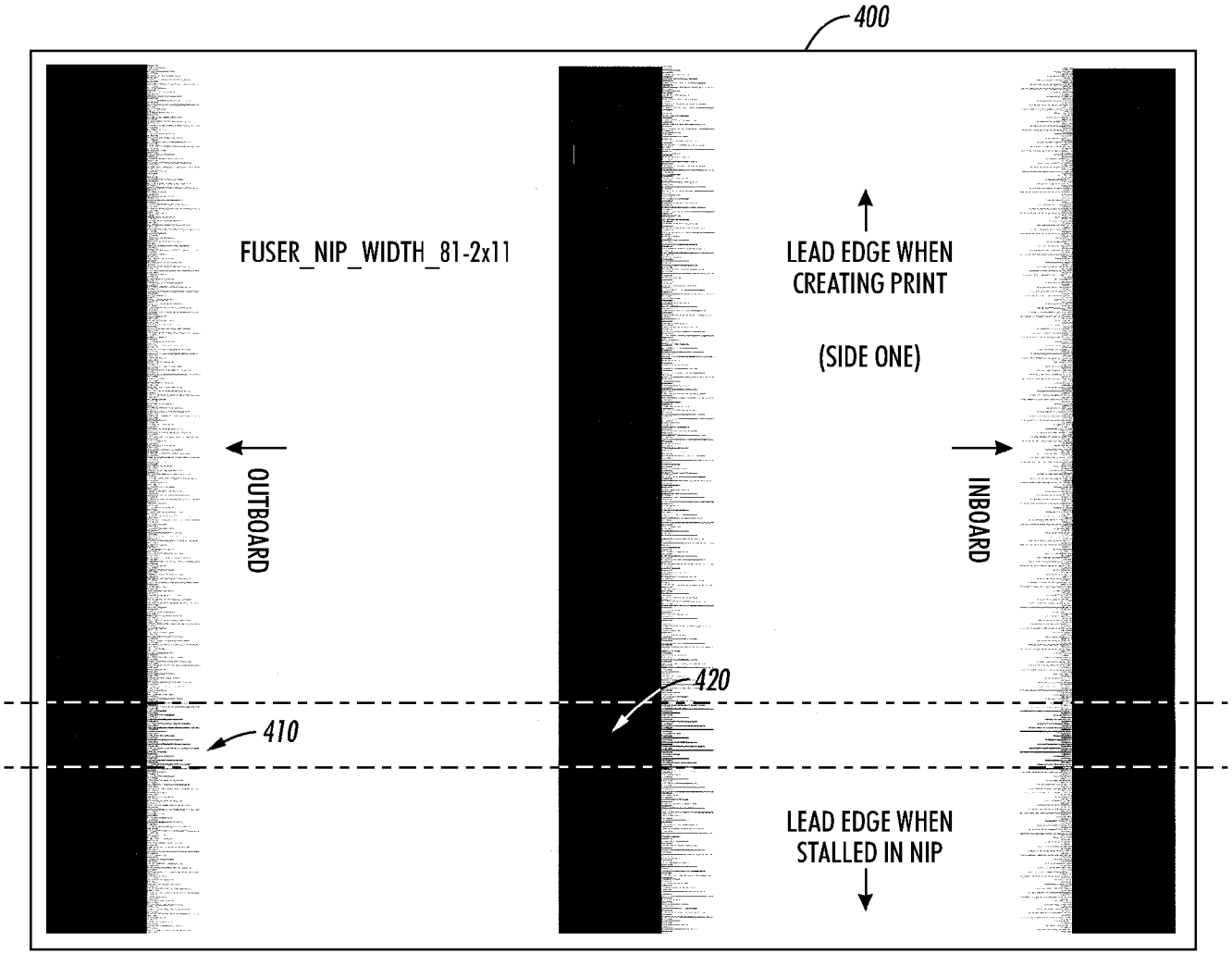
FIG. 4 is an exemplary nip print test image in accordance with one possible embodiment of the disclosure.
Figure 5:
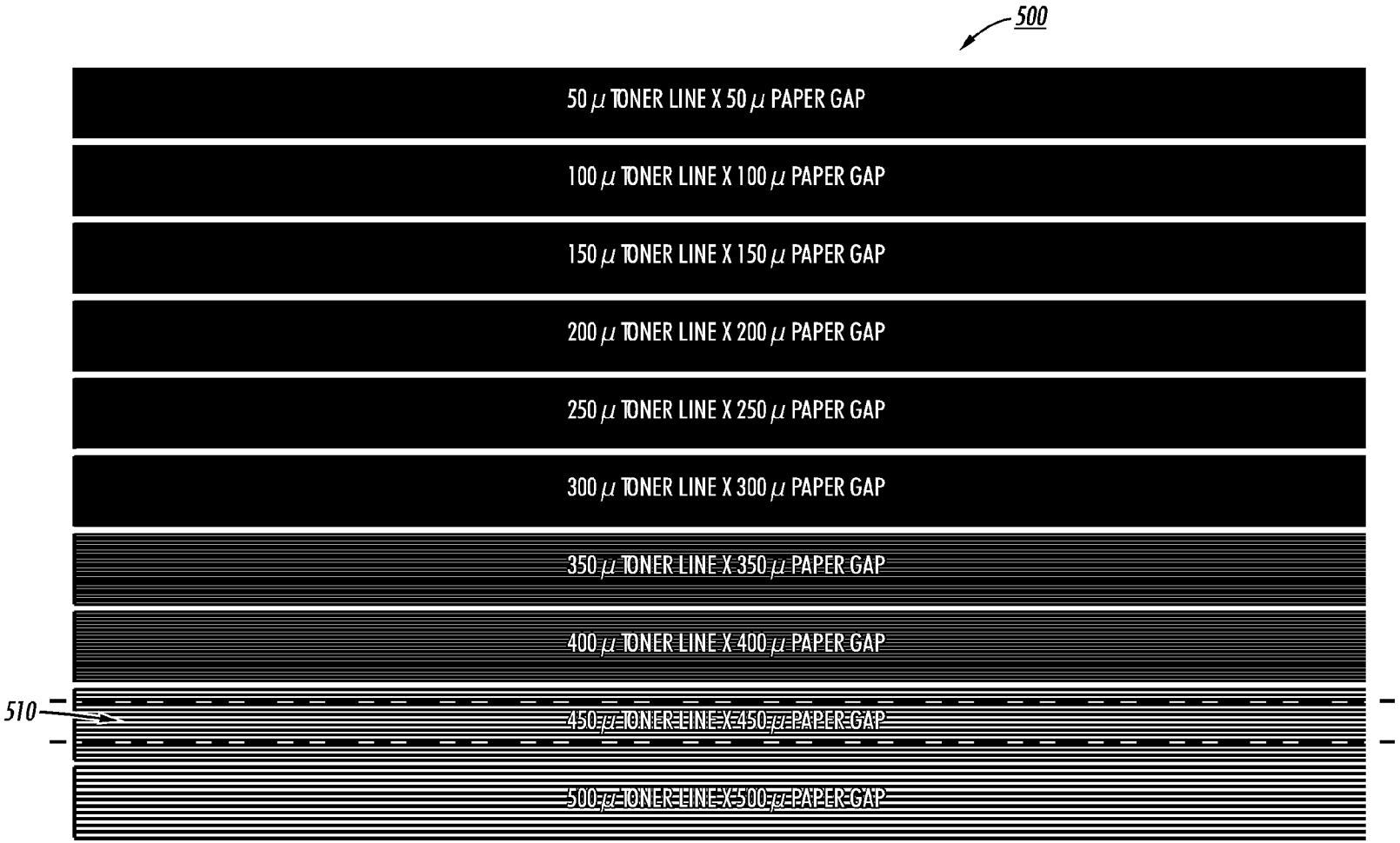
FIG. 5 is another exemplary nip print test image in accordance with one possible embodiment of the disclosure.

Examples of nip print images 400, 500 are shown in FIGS. 4 and 5, respectfully. The nip print may be a delta gloss image or a pressure sensitive film image, for example. FIG. 4 is a nip print currently used in an image production machine. The scale is in known increments, and thus can also be read by an operator. One can see in the image where the band of lines 410 is darker on the scale, representing a higher delta gloss. The nip print scanner 195 may detect the change in gloss across a small area in order to determine the length of the nip width. In addition, the half tone band 420 may be used and scanned to determined where the gloss changes, representing nip width length, for example.

FIG. 5 is not a nip print itself but may be used to work in a similar manner where the lines are a known distance apart resulting in more precise determination of nip width than shown in FIG. 4. Band 510 may represent a nip width area, for example. The resulting scan may determine gloss change in band 510 which may determine the nip width area.

The nip print may then be jettisoned toward the nip print scanner 195. The nip print scanner 195 may be located in the path after the nip and may be positioned in the simplex (single side) or the duplex (double side) media sheet path. The nip print is then scanned by the scanner 195 and the information is provided to the nip width adjustment unit 250. The nip print may be scanned on each edge of the fuser roll 170, such as the inboard and outboard edges, for example.

The nip print scanning process may be scheduled by an operator or in the factory such that a nip print may be generated and scanned automatically upon fuser roll replacement or on a periodic basis, for example.

If the nip print scanning process dictates, the nip width adjustment unit 250 may use the nip width adjustment device 310 to change the nip width by adjusting the distance between the fuser roll 170 and the pressure roll 180. The nip width adjustment device 310 shown in FIG. 3 may be a rotary cam-type adjustment device that automatically raises or lowers the pressure roll 180 to adjust the pressure exerted upon the fuser roll 170 by the pressure roll 180 and hence, adjust the nip width. Note that while the nip width adjustment device 310 is illustrated to be within the pressure roll 20 in FIG. 3, alternative arrangements may be used without limitation, including a cam and cam follower device, shim adjustment device, or a spring adjustment device, for example. In addition, the nip width adjustment device 310 may also be installed on the fuser roll 170, for example.

Upon appropriate rotation of nip width adjustment device 310 (the rotary cam), the position of the pressure roll is adjusted. Thus, appropriate rotation of the nip width adjustment device 310 (the rotary cam) can move the pressure roll 180 toward the fuser roll 170, thereby increasing the amount of pressure exerted by the pressure roll 180 upon the fuser roll 170. Control of the nip width adjustment device 310 by the nip width adjustment unit 250 may be implemented by any means well known in the art.

The operation of components of the nip width adjustment unit 250, the nip print scanner 195, and the fuser roll adjustment process will be discussed in relation to the flowchart in FIG. 6.

Figure 6:
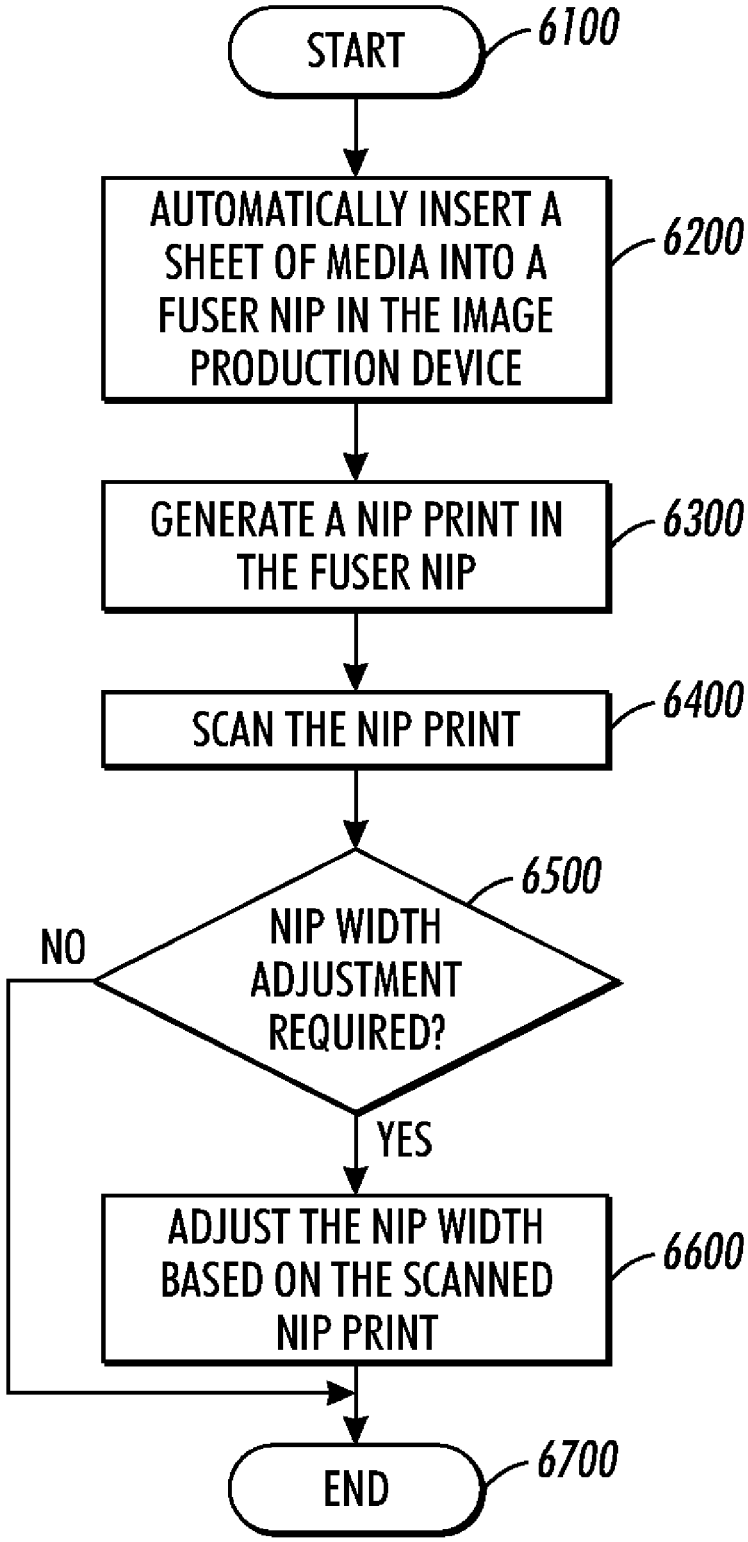
FIG. 6 is a flowchart of an exemplary a nip width adjusting process in accordance with one possible embodiment of the disclosure.

FIG. 6 is a flowchart of an exemplary fuser roll adjustment process in accordance with one possible embodiment of the disclosure. The method begins at 6100, and continues to 6200 where the feeder section 110 receives a signal to automatically insert a sheet of media into a fuser nip 190 in the image production device 100 upon receiving a signal from the user interface 150. The sheet of media may be paused in the fuser nip for a predetermined time period, such as 10-30 seconds, for example. At step 6300, the nip width adjustment unit 250 may generate a nip print in the fuser nip 190. At step 6400, the nip width adjustment unit 250 may send a signal to the scanner 195 to scan the nip print.

At step 6500, the nip width adjustment unit 250 may determine if a nip width adjustment is required based on the scanned nip print. If the nip width adjustment unit 250 determines that a nip width adjustment is not required based on the scanned nip print, the process may then go to step 6700 and end. However, if the nip print adjustment unit 250 determines that a nip width adjustment is required based on the scanned nip print, then at step 6600, the nip print adjustment unit 250 adjusts the nip width using the nip width adjustment device 310. The process may then go to step 6700 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for automatically adjusting nip width based on a scanned nip print in an image production device, comprising:

automatically inserting a sheet of media into a fuser nip in the image production device upon receiving a signal from a user interface, the fuser nip being an intersection of the fuser roll and the pressure roll and the sheet of media being paused in the fuser nip for a predetermined time period;

generating a nip print in the fuser nip, the nip print being an image created from the pressure between the fuser roll and the pressure roll;

scanning the nip print;

determining if a nip width adjustment is required based on the scanned nip print, the nip width being the distance of an arc length created by an intersection of the fuser roll and the pressure roll, and if it is determined that a nip width adjustment is required based on the scanned nip print, adjusting the nip width.

2. The method of claim 1, wherein the nip print is scanned in one of a simplex loop and a duplex loop.

3. The method of claim 1, wherein the nip print is one of a delta gloss image and a pressure sensitive film image.

4. The method of claim 1, wherein the nip print is generated and scanned automatically upon at least one of fuser roll replacement and on a periodic basis.

5. The method of claim 1, wherein the nip print is scanned on at least each edge of the fuser roll.

6. The method of claim 1, wherein the predetermined time period is between 10-30 seconds.

7. The method of claim 1, wherein the image production device is one of a copier, a printer, a facsimile device, and a multi-function device.

8. An image production device, comprising:

a user interface that receives inputs from an operator;

a feeder section that feeds media sheets to produce images in the image production device;

a scanner that scans a nip print, the nip print being an image created from the pressure between the fuser roll and the pressure roll; and a nip print adjustment unit that sends a signal to the feeder section to automatically insert a sheet of media into a fuser nip in the image production device upon receiving a signal from the user interface, the fuser nip being an intersection of the fuser roll and the pressure roll and the sheet of media being paused in the fuser nip for a predetermined time period, generates a nip print in the fuser nip, sends a signal to the scanner to scan the nip print, determines if a nip width adjustment is required based on the scanned nip print, the nip width being the distance of an arc length created by an intersection of the fuser roll and the pressure roll, and if the nip print adjustment unit determines that a nip width adjustment is required based on the scanned nip print, the nip print adjustment unit adjusts the nip width.

9. The image production device of claim 8, wherein the scanner scans the nip print in one of a simplex loop and a duplex loop.

10. The image production device of claim 8, wherein the nip print is one of a delta gloss image and a pressure sensitive film image.

11. The image production device of claim 8, wherein the nip print is generated and scanned automatically upon at least one of fuser roll replacement and on a periodic basis.

12. The image production device of claim 8, wherein the scanner scans the nip print on at least each edge of the fuser roll.

13. The image production device of claim 8, wherein the predetermined time period is between 10-30 seconds.

14. The image production device of claim 8, wherein the image production device is one of a copier, a printer, a facsimile device, and a multi-function device.

15. A non-transitory computer-readable medium storing instructions for controlling a computing device for automatically adjusting nip width based on a scanned nip print in an image production device, the instructions comprising:

automatically inserting a sheet of media into a fuser nip in the image production device upon receiving a signal from a user interface, the fuser nip being an intersection of the fuser roll and the pressure roll and the sheet of media being paused in the fuser nip for a predetermined time period;

generating a nip print in the fuser nip, the nip print being an image created from the pressure between the fuser roll and the pressure roll;

scanning the nip print;

determining if a nip width adjustment is required based on the scanned nip print, the nip width being the distance of an arc length created by an intersection of the fuser roll and the pressure roll, and if it is determined that a nip width adjustment is required based on the scanned nip print, adjusting the nip width.

16. The computer-readable medium of claim 15, wherein the nip print is scanned in one of a simplex loop and a duplex loop.

17. The computer-readable medium of claim 15, wherein the nip print is one of a delta gloss image and a pressure sensitive film image.

18. The computer-readable medium of claim 15, wherein the nip print is generated and scanned automatically upon at least one of fuser roll replacement and on a periodic basis.

19. The computer-readable medium of claim 15, wherein the nip print is scanned on at least each edge of the fuser roll.

20. The computer-readable medium of claim 15, wherein the predetermined time period is between 10-30 seconds.

21. The computer-readable medium of claim 15, wherein the image production device is one of a copier, a printer, a facsimile device, and a multi-function device.

* * * * *